US011710921B2

(12) United States Patent
Tsuchiya et al.

(10) Patent No.: US 11,710,921 B2
(45) Date of Patent: Jul. 25, 2023

(54) CONNECTOR WITH METAL SPRING

(71) Applicant: SMK Corporation, Tokyo (JP)

(72) Inventors: Hirotaka Tsuchiya, Tokyo (JP); Fumio Osawa, Tokyo (JP); Tadahito Sasaki, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 17/721,354

(22) Filed: Apr. 15, 2022

(65) Prior Publication Data

US 2023/0103190 A1 Mar. 30, 2023

(30) Foreign Application Priority Data

Sep. 24, 2021 (JP) ..... 2021-155385

(51) Int. Cl.

| | |
|---|---|
| ***H01R 13/18*** | (2006.01) |
| ***H01R 13/508*** | (2006.01) |
| *H01R 13/627* | (2006.01) |
| *H01R 12/91* | (2011.01) |

(52) U.S. Cl.

CPC ..... *H01R 13/18* (2013.01); *H01R 13/508* (2013.01); *H01R 12/91* (2013.01); *H01R 13/6277* (2013.01)

(58) Field of Classification Search

CPC .. H01R 13/18; H01R 13/508; H01R 13/6277; H01R 12/91; H01R 13/6315

See application file for complete search history.

(56) References Cited

U.S. PATENT DOCUMENTS

| | | | | |
|---|---|---|---|---|
| 6,386,914 | B1 | 5/2002 | Collins | |
| 10,756,455 | B2 * | 8/2020 | Bence | H01R 24/44 |
| 2009/0047814 | A1 | 2/2009 | Daamen | |
| 2020/0313355 | A1 * | 10/2020 | Bronk | H01R 13/502 |

FOREIGN PATENT DOCUMENTS

| | | |
|---|---|---|
| EP | 2104188 A1 | 9/2009 |
| JP | 3683864 B2 | 8/2005 |

OTHER PUBLICATIONS

Extended European Search Report for counterpart European Application No. 22171416.5, issued by the European Patent Office dated Oct. 20, 2022.

* cited by examiner

*Primary Examiner* — Oscar C Jimenez
*Assistant Examiner* — Paul D Baillargeon

(57) ABSTRACT

The connector includes: an axial member that is a cylindrical conductor; a central contact disposed inside along a central axis of the axial member; an insulating member interposed between the axial member and the central contact and which holds the central contact; a first flange and a second flange provided on an outer peripheral surface of the axial member; and a metal spring provided along an outer peripheral surface of the axial member. The metal spring includes: a C-shaped metal spring body; curved parts; elastic pieces that extend from the curved parts so as to face an outer peripheral surface of the metal spring body; inner protrusions provided on an inner peripheral surface of the metal spring body so as to protrude inside the metal spring body; and outer protrusions provided on outer peripheral surfaces of the elastic pieces so as to protrude outside the elastic pieces.

9 Claims, 15 Drawing Sheets

CONNECTOR WITH METAL SPRING

The contents of the following Japanese patent application (s) are incorporated herein by reference:
NO. 2021-155385 filed on Sep. 24, 2021.

FIELD

The present invention relates to a connector with a metal spring.

BACKGROUND

Connectors that have a ring-shaped elastic metal member on an outer periphery of an inner conductor to electrically connect the cylindrical inner conductor and a cylindrical outer conductor provided outside the inner conductor are known.

Specifically, as such a connector, a connector with a retaining clip (400), which is an elastic metal member to electrically connect between an outer periphery of a cylindrical contact (700), serving as an inner conductor, and an inner periphery of a cylindrical outer connector body (200), serving as an outer conductor, is known (see, for example, Patent Literature 1).

In the connector disclosed in Patent Literature 1, the retaining clip (400) has an elastic protrusion (490), and the inner contact (700) and the elastic protrusion (490) are in contact with each other. In addition, an outer peripheral surface of the retaining clip (400) is in contact with an inner peripheral surface of the outer connector body (200). Thereby, the inner contact (700) and the outer connector body (200) are electrically connected via the retaining clip (400).

In the above-described connector, even when misalignment or the like occurs during use of the connector, elastic deformation of the elastic protrusion (490) is able to maintain the contact between the inner contact (700) and the elastic protrusion (490).

CITATION LIST

Patent Literature

Patent Literature 1: Japanese Patent No. 3683864

SUMMARY

Technical Problem

However, contact between the outer peripheral surface of the retaining clip (400) and the inner peripheral surface of the outer connector body (200) is made between curved surfaces. Therefore, when misalignment or the like occurs during use of the connector, stable contact between the outer peripheral surface of the retaining clip (400) and the inner peripheral surface of the outer connector body (200) may not always be maintained. Therefore, the inner contact (700) and the outer connector body (200) may not always have a stable electric connection.

The present invention has been made with the purpose of solving such problems, and an object thereof is to provide a connector that is capable of electrically connecting the inner conductor and the outer conductor with stability.

Solution to Problem

To achieve the above-described object, a connector according to an aspect of the present invention includes: an inner conductor that is a cylindrical conductor; a central contact that is disposed inside along a central axis of the inner conductor; an insulating member that is interposed between the inner conductor and the central contact and which holds the central contact; a first flange and a second flange that are provided on an outer peripheral surface of the inner conductor spaced apart in a direction of the central axis; and a metal spring that is fitted in between the first flange and the second flange and is provided along the outer peripheral surface of the inner conductor. The metal spring includes: a C-shaped metal spring body which has a gap between both ends separated by a cutout in a cylindrical metal; a pair of curved parts connected in a curve to both the ends of the metal spring body; a pair of elastic pieces that extend from the pair of curved parts, respectively, so as to face an outer peripheral surface of the metal spring body; an inner protrusion that is provided on an inner peripheral surface of the metal spring body so as to protrude inside the metal spring body, and be in contact with the inner conductor with an elastic force; and an outer protrusion that is provided on an outer peripheral surface of the elastic piece so as to protrude outside the elastic piece, and be in contact with a cylindrical outer conductor provided outside the inner conductor with an elastic force.

With this configuration, the connector according to the aspect of the present invention is configured in such a manner that the inner protrusion provided on the inner peripheral surface of the metal spring body is in contact with the inner conductor with an elastic force, and the outer protrusion provided on the outer peripheral surface of the elastic piece, which is located on the metal spring, is in contact with the outer conductor with an elastic force. Therefore, the connector according to the aspect of the present invention enables stable electric connection between the inner conductor and the outer conductor via the metal spring even when there is misalignment or the like between parts during use of the connector.

In addition, curved parts, which are curved and folded back, are connected to both ends of the metal spring body, and the metal spring body is formed in the shape of the letter C. Therefore, when the metal spring is attached to the inner conductor from a side direction, the metal spring can be easily attached to the inner conductor by opening both the ends of the C-shaped metal spring.

In the connector with the above-described configuration, an outer diameter of the first flange may be configured to be larger than an outer diameter formed by the outer peripheral surfaces of the elastic pieces around a central axis of the inner conductor.

With this configuration, in the connector according to the present embodiment, the outer diameter of the first flange is larger than the outer diameter formed by the outer peripheral surfaces of the elastic pieces around the central axis of the inner conductor, so when the outer conductor is attached to the inner conductor, it is possible to prevent the elastic pieces from buckling and being damaged.

In the connector with the above-described configuration, the outer diameter of the first flange may be configured to be larger than an outer diameter of the second flange.

With this configuration, in the connector according to the aspect of the present invention, since the outer diameter of the first flange is larger than the outer diameter of the second flange, the outer peripheral surface of the second flange can be in contact with the outer conductor, while a top surface of the first flange is in contact with the outer conductor.

In the connector with the above-described configuration, a third flange may further be provided on the outer peripheral surface of the inner conductor, and an O-ring for waterproofing may be fitted in between the second flange and the third flange.

With this configuration, in the connector according to the aspect of the present invention, the O-ring for waterproofing is fitted in between the second flange and the third flange, making it possible to prevent water from the flange side from flowing to the side of an enclosure which includes the outer conductor.

In the connector with the above-described configuration, the outer protrusion may include a plurality of outer protrusions provided on the outer peripheral surfaces of the pair of elastic pieces.

According to this configuration, the connector according to the aspect of the present invention can disperse an external force that the elastic pieces receive from the outer conductor.

In the connector with the above-described configuration, the outer protrusion may be provided one each at each tip of the pair of elastic pieces.

With this configuration, the connector according to the aspect of the present invention has the outer protrusion one each at each tip of the pair of elastic pieces. Therefore, it is easier to transmit a force from pressure to the metal spring body than in the case of providing the outer protrusions on sides closer to the curved parts. It is also possible to prevent the metal spring from being plastically deformed by deformations exceeding an elastic range of the metal spring.

In the connector with the above-described configuration, the inner protrusion may include a plurality of inner protrusions provided on the inner peripheral surface of the metal spring body.

With this configuration, the connector according to the present embodiment allows contact between the inner protrusion and the inner conductor at more points.

In the connector with the above-described configuration, the inner protrusion may be provided one each on each end of the inner peripheral surface of the C-shaped metal spring body.

With this configuration, the connector according to the aspect of the present invention has the inner protrusion one each on each end of the inner peripheral surface of the C-shaped metal spring body. This makes it easier to transmit a force from pressure to the inner conductor than when the inner protrusions are provided on sides further away from the curved parts, thus ensuring contact pressure between the inner protrusion and the inner conductor.

In the connector with the above-described configuration, an outer peripheral end of the first flange may be configured so as to engage with a flange engagement portion in the enclosure which includes the outer conductor.

According to the aspect of the present invention, it is possible to provide a connector that can electrically connect between the inner conductor and the outer conductor with stability.

DESCRIPTION OF EMBODIMENTS

A connector 1 according to the present embodiment will be described below with reference to FIGS. 1 to 13. First, the structure of the connector 1 will be described.

Figure 1:
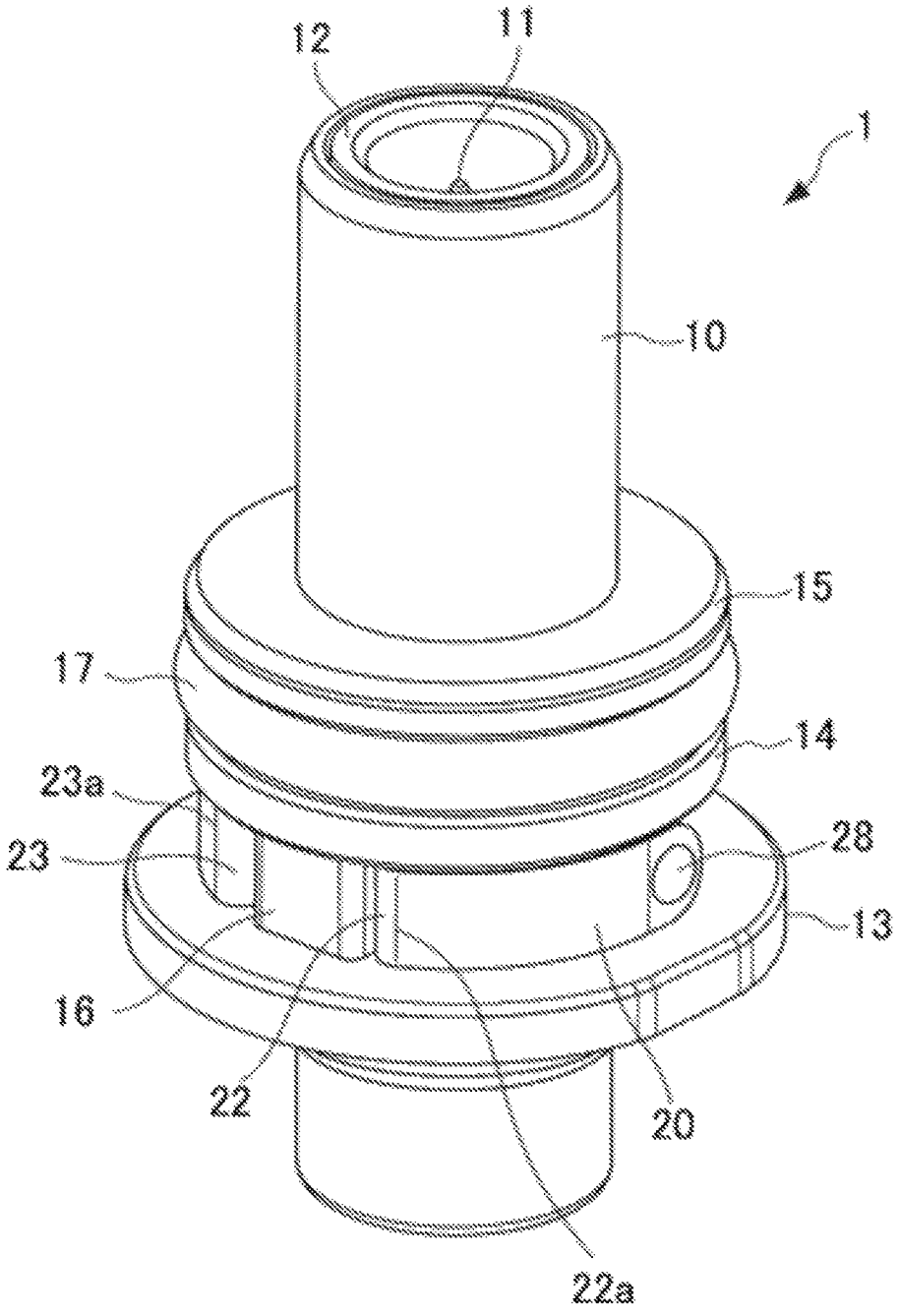
FIG. 1 is a perspective view illustrating a connector according to an embodiment of the present invention.
Figure 2A:
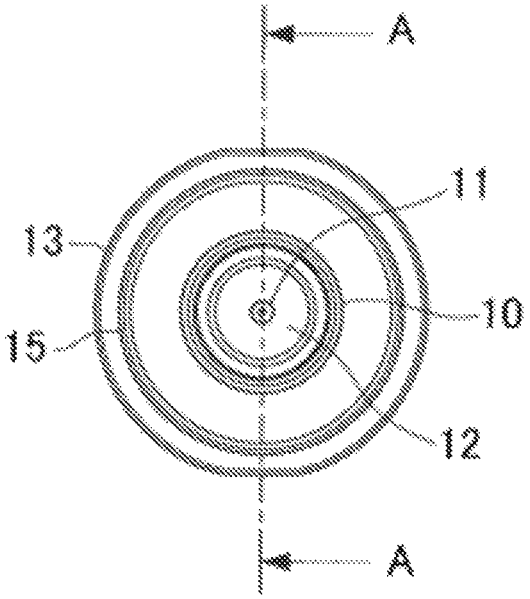
FIG. 2A is a drawing of a top plan view of the connector according to the embodiment of the present invention.
Figure 2B:
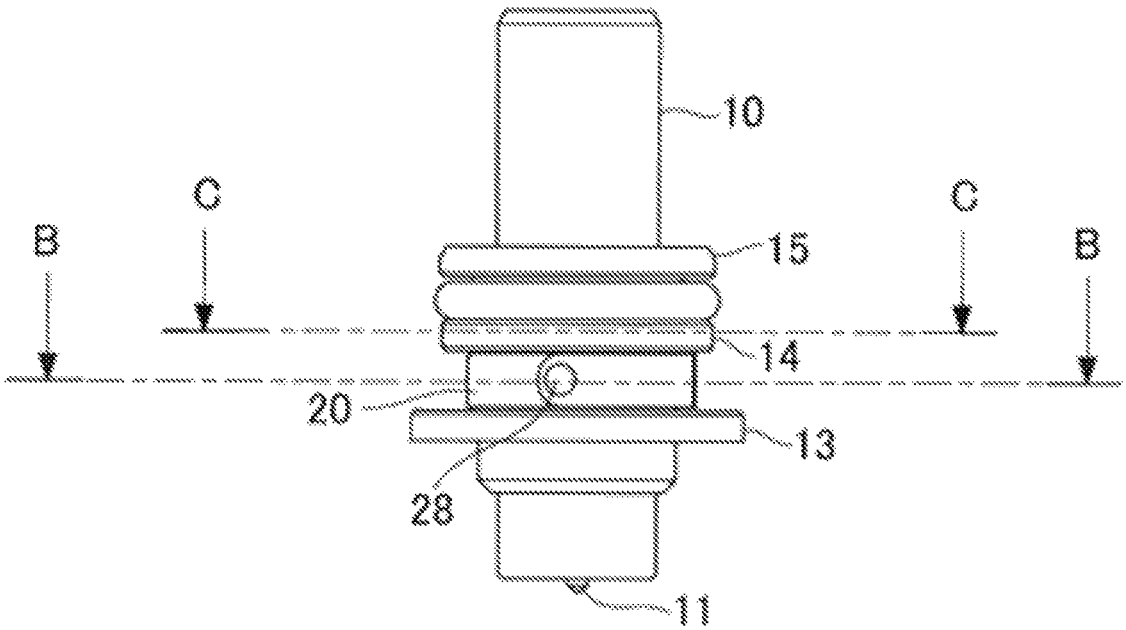
FIG. 2B is a drawing of a front view of the connector according to the embodiment of the present invention.
Figure 2C:
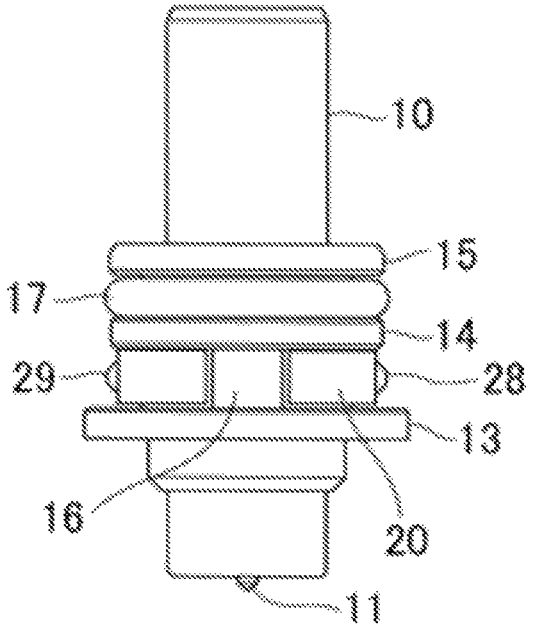
FIG. 2C is a drawing of a right side view of the connector according to the embodiment of the present invention.
Figure 3:
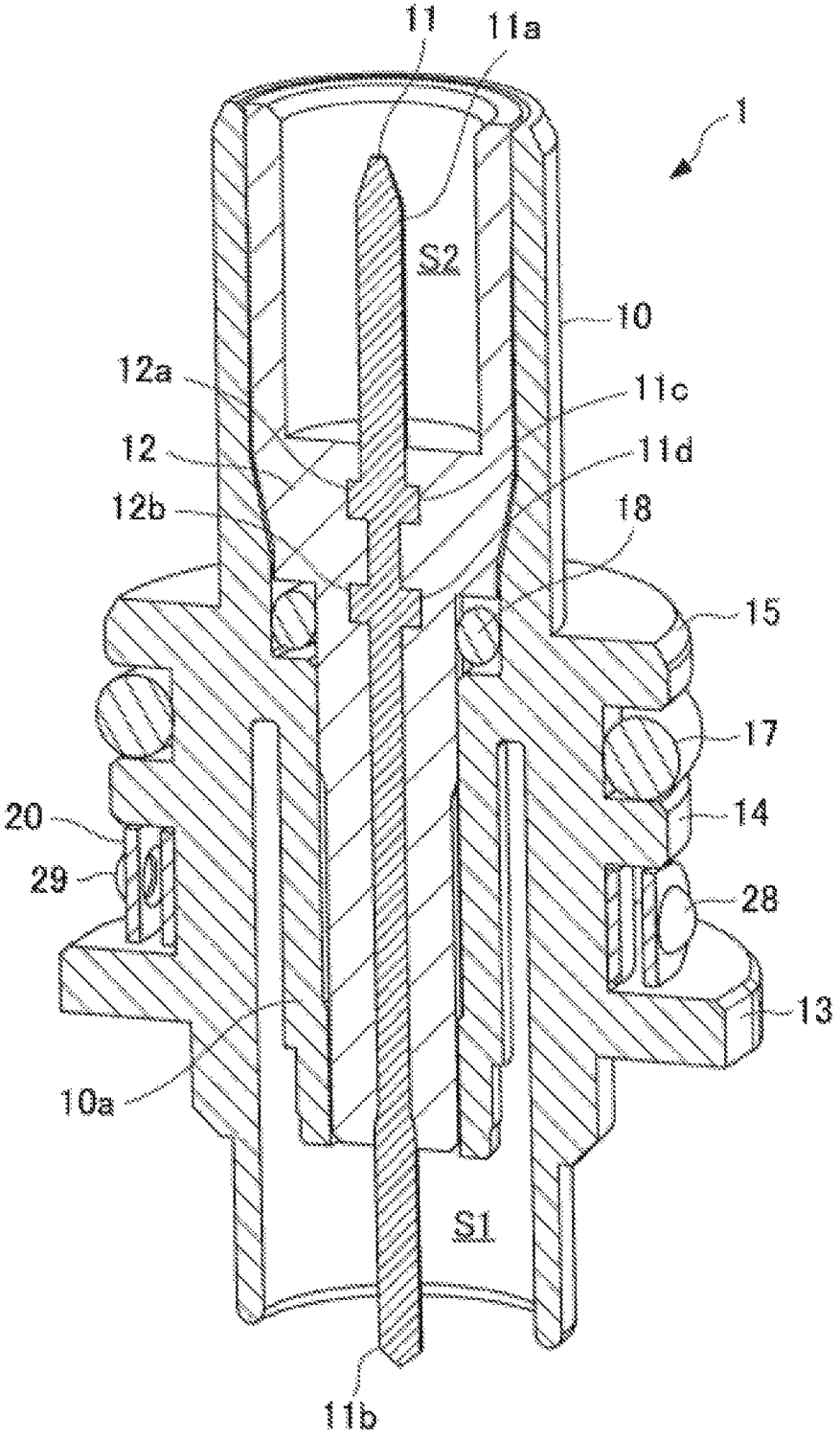
FIG. 3 is a cross sectional view of the connector according to the embodiment of the present invention, taken along line A-A of FIG. 2A.

FIG. 1 is a perspective view of the connector 1 according to the present embodiment. FIGS. 2A to 2C are drawings of the connector 1 according to the present embodiment viewed from various directions, in which FIG. 2A is a top plan view, FIG. 2B is a front view, and FIG. 2C is a right side view. FIG. 3 is a cross sectional view of the connector 1 according to the present embodiment, taken along line A-A of FIG. 2A.

The connector 1 includes an axial member 10, a central contact 11, an insulating member 12, a first flange 13, a second flange 14, a third flange 15, a protrusion 16, an O-ring 17, an O-ring 18, and a metal spring 20.

Figure 4:
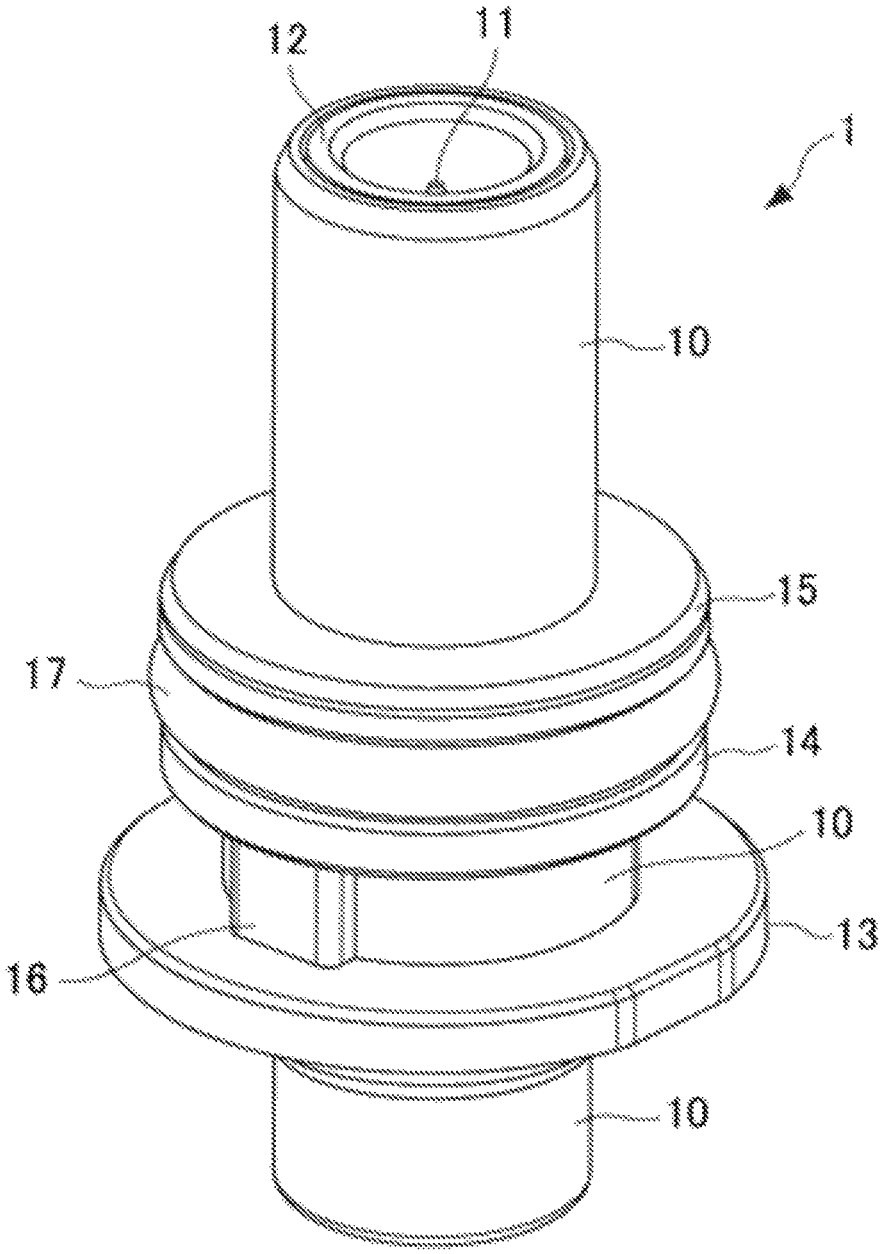
FIG. 4 is a perspective view of the connector according to the embodiment of the present invention before a metal spring is assembled.

FIG. 4 is a perspective view of the contact 1 before the metal spring 20, which will be described below, is assembled.

The axial member 10 is a cylindrical metal conductor. As a material of the axial member 10, for example, a zinc die-casting, brass, or the like is used. The axial member 10 is electrically connected to a cylindrical member 41 via the metal spring 20, as described below. The axial member 10 corresponds to the inner conductor according the present invention.

As illustrated in FIG. 3, the axial member 10 has a cylindrical piece 10*a* formed inside in a cylindrical shape. The cylindrical piece 10*a*, together with the central contact 11, is fitted in a mating connector, which is not illustrated in the drawings, in a space S1 formed inside the axial member 10.

As illustrated in FIG. 2A and FIG. 3, the central contact 11 is a needle-shaped member placed inside the axial member 10 along a central axis of the cylindrical axial member 10. As a material of the central contact 11, for example, a copper alloy is used. The central contact 11 is surrounded and held by the insulating member 12, which will be described below.

The mating connector, which is not illustrated in the drawings, is connected from above the contact 1 illustrated in FIG. 3 in a space S2 surrounded by the insulating member 12. An upper end 11*a* of the central contact 11 is in contact with a contact provided in the above-described mating connector. Below the contact 1, a mating connector mounted on a not-illustrated board in a rear case 40, which will be described below, is connected in the space S1. A lower end 11*b* of the central contact 11 is in contact with a contact provided in the mating connector described above. The central contact 11 is thus in contact with each of the contacts provided in the respective mating connectors, and constitutes a communication path for electrical signals.

As illustrated in FIG. 3, the insulating member 12 is interposed between the axial member 10 and the central contact 11, and holds the central contact 11. Specifically, an upper engagement portion 12*a* of the insulating member 12 engages with an engagement portion 11*c* of the central contact 11, and a lower engagement portion 12*b* of the insulating member 12 engages with an engagement portion 11*d* of the central contact 11, so that the insulating member 12 holds the central contact 11. The insulating member 12 is a member made of an insulating resin and is interposed between the axial member 10 and the central contact 11 to insulate the central contact 11 from the axial member 10.

As illustrated in FIG. 1, the contact 1 includes three flanges, i.e. the first flange 13, the second flange 14, and the third flange 15 in this order from the bottom on an outer peripheral surface of the cylindrical axial member 10. In the present embodiment, the number of the flanges provided on the axial member 10 is three, but the number of flanges is not limited to this, and may be one, two, or four or more. As a material of the first flange 13, the second flange 14, and the third flange 15, for example, a zinc die-casting, brass, or the like is used as with the axial member 10.

The first flange 13 is located on the outer peripheral surface of the axial member 10 in a central axial direction at distances from the second flange 14 and the third flange 15. The distance between the first flange 13 and the second flange 14 is, for example, approximately the same as the order of the height of the metal spring 20, in order to allow fitting of the metal spring 20, as described later, but may be larger than the height of the metal spring 20. The distance between the second flange 14 and the third flange 15 is, for example, approximately the same as the order of the height of the O-ring 17, in order to allow fitting of the O-ring 17, as described later, but may be larger than the height of the O-ring 17.

Figure 5:
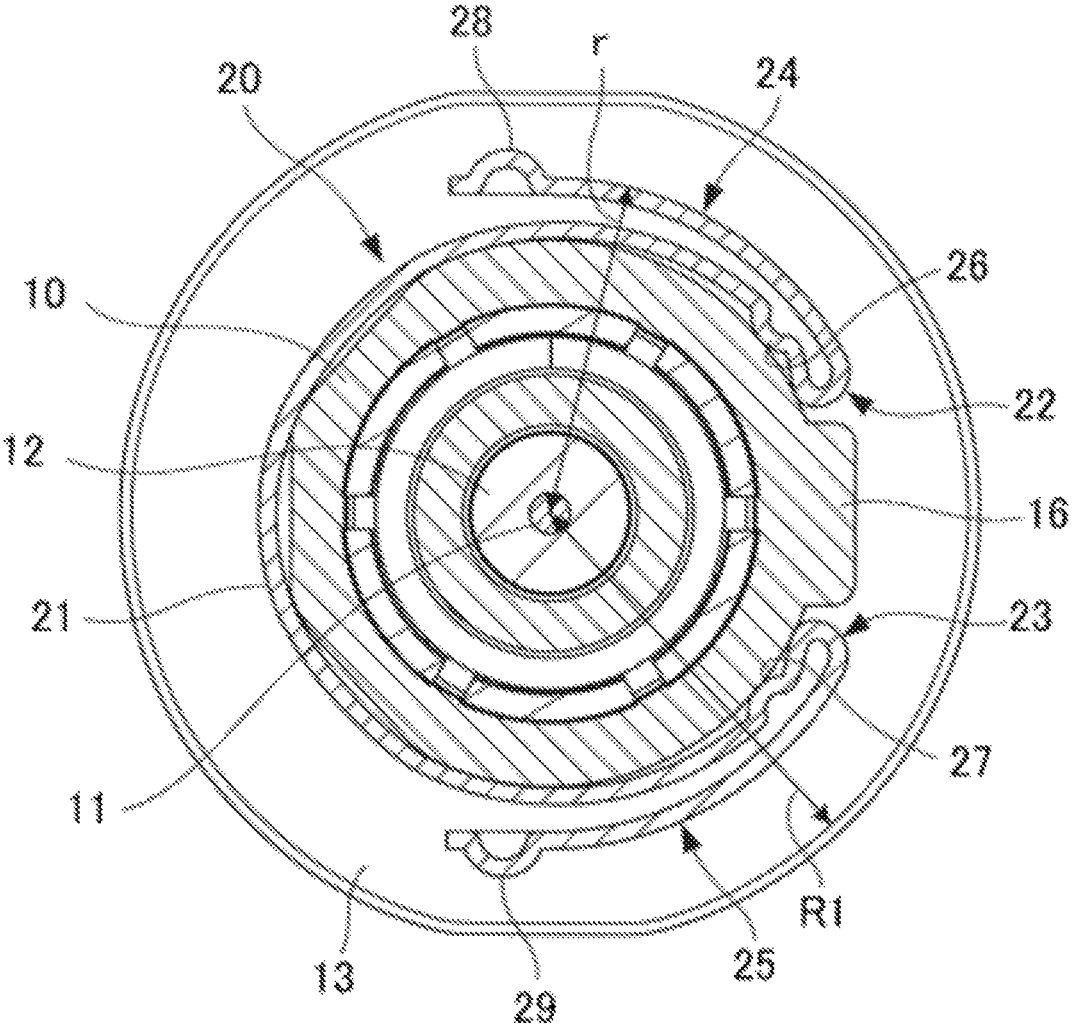
FIG. 5 is a cross sectional view of the connector according to the embodiment of the present invention, taken along line B-B of FIG. 2B.
Figure 6:
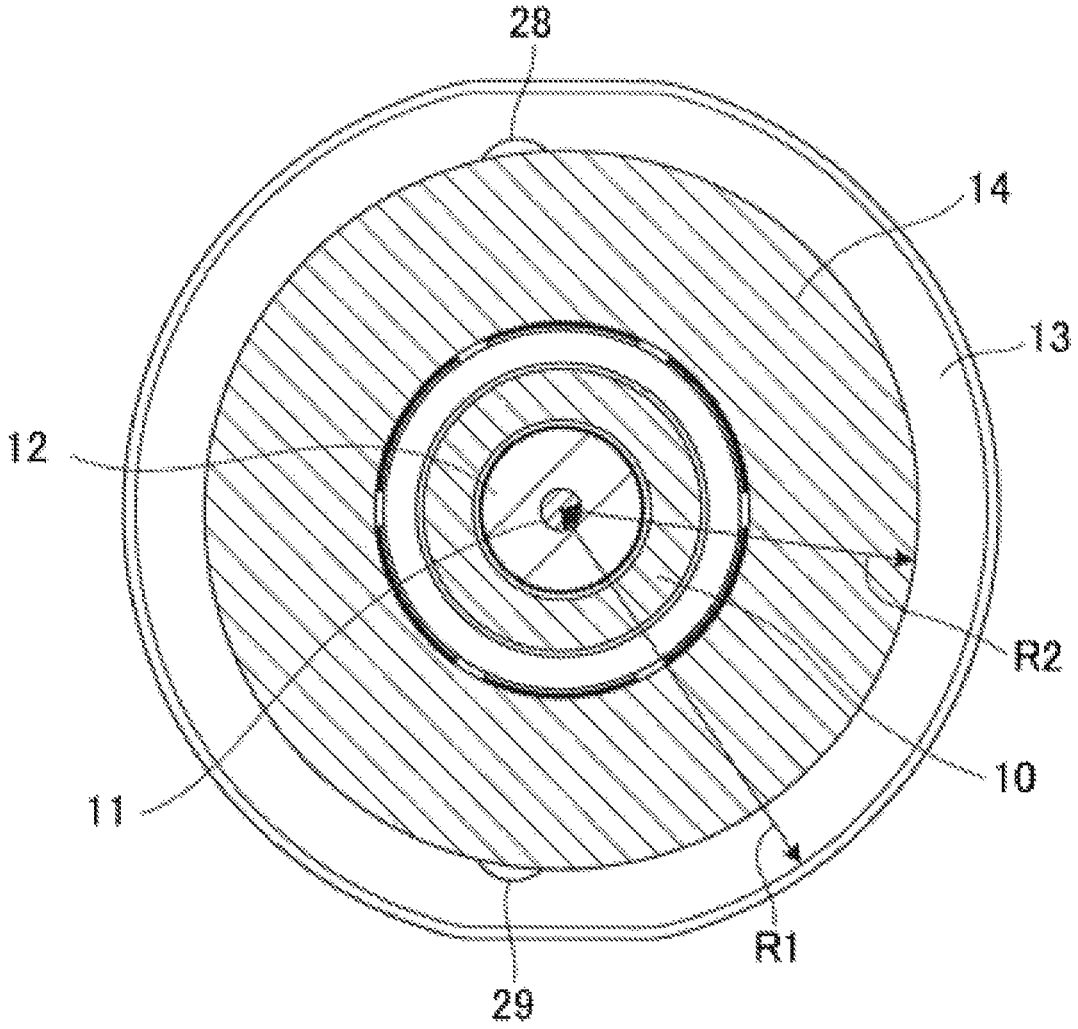
FIG. 6 is a cross sectional view of the connector according to the embodiment of the present invention, taken along line C-C of FIG. 2B.

FIG. 5 illustrates a cross sectional view of the connector 1 according to the present embodiment, taken along line B-B of FIG. 2B. FIG. 6 illustrates a cross sectional view of the connector 1 according to the present embodiment, taken along line C-C of FIG. 2B.

As illustrated in FIG. 5, an outer diameter R1 of the first flange 13 is configured to be larger than an outer diameter r formed by outer peripheral surfaces of elastic pieces 24 and 25 around the central axis of the axial member 10, but the outer diameter R1 of the first flange 13 is not necessarily limited to this.

The outer diameter R1 of the first flange 13 is larger than the outer diameter r formed by the outer peripheral surfaces of the elastic pieces 24 and 25 around the central axis of the axial member 10, so when the cylindrical member 41 is attached to the axial member 10, it is possible to prevent the elastic pieces 24 and 25 from buckling and being damaged.

In other words, if the outer diameter R1 of the first flange 13 is smaller than the outer diameter r formed by the outer peripheral surfaces of the elastic pieces 24 and 25, when the cylindrical member 41 is attached to the axial member 10, the elastic pieces 24 and 25 and the cylindrical member 41 come into direct contact with each other, which may cause the elastic pieces 24 and 25 to buckle and be damaged, thus these measures prevent such a situation from occurring.

Also, as illustrated in FIG. 6, the outer diameter R1 of the first flange 13 is configured to be larger than an outer diameter R2 of the second flange 14, but the outer diameter R1 of the first flange 13 is not necessarily limited to this. Since the outer diameter R1 of the first flange 13 is larger than the outer diameter R2 of the second flange 14, an outer peripheral surface of the second flange 14 can be in contact with the cylindrical member 41, while a top surface of the first flange 13 is in contact with the cylindrical member 41.

The protrusion 16 is, as illustrated in FIG. 4, a member on the outer peripheral surface of the axial member 10, between the first flange 13 and the second flange 14. As a material of the protrusion 16, for example, a zinc die-casting, brass, or the like is used as with the axial member 10.

In the contact 1 in which the metal spring 20, which will be described below, is assembled on the axial member 10, as illustrated in FIG. 5, the protrusion 16 has such a size as to be fitted in a gap between U-shaped curved parts 22 and 23 of the metal spring 20. The distance between the outer peripheral surface of the protrusion 16 and the central contact 11 is approximately the same as the outer diameter r formed by the outer peripheral surfaces of the elastic pieces 24 and 25 around the central axis of the axial member 10.

As illustrated in FIG. 1, the O-ring 17 is a waterproof member that is fitted on the outer peripheral surface of the axial member 10 in between the second flange 14 and the third flange 15. The provision of the waterproof O-ring 17 in the connector 1 prevents water from the flange side from flowing to the side with the rear case 40 including the cylindrical member 41, which will be described below.

As illustrated in FIG. 3, the O-ring 18 is a waterproof member fitted inside the axial member 10 in a space formed above the cylindrical piece 10*a* between the cylindrical piece 10*a* and the insulating member 12. The provision of the waterproof O-ring 18 in the connector 1 prevents water from flowing from between the axial member 10 and the insulating member 12 to the side with the rear case 40 including the cylindrical member 41, which will be described below.

Figure 7:
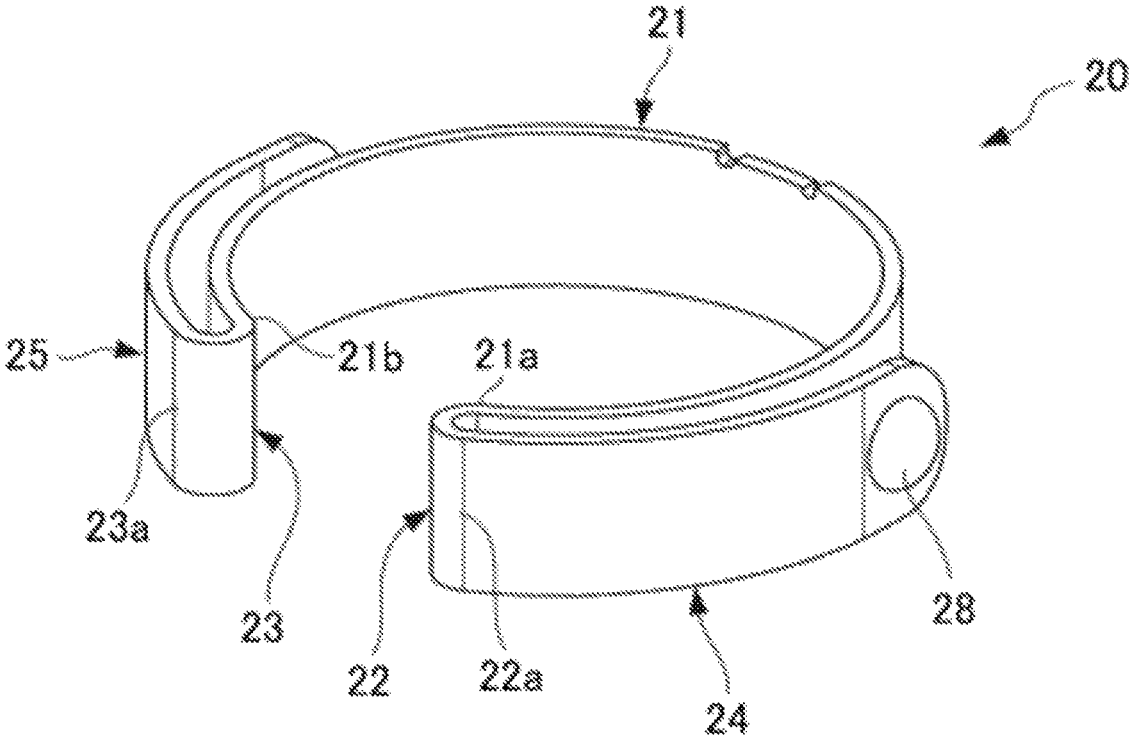
FIG. 7 is a perspective view of the metal spring used in the connector according to the embodiment of the present invention.
Figure 8:
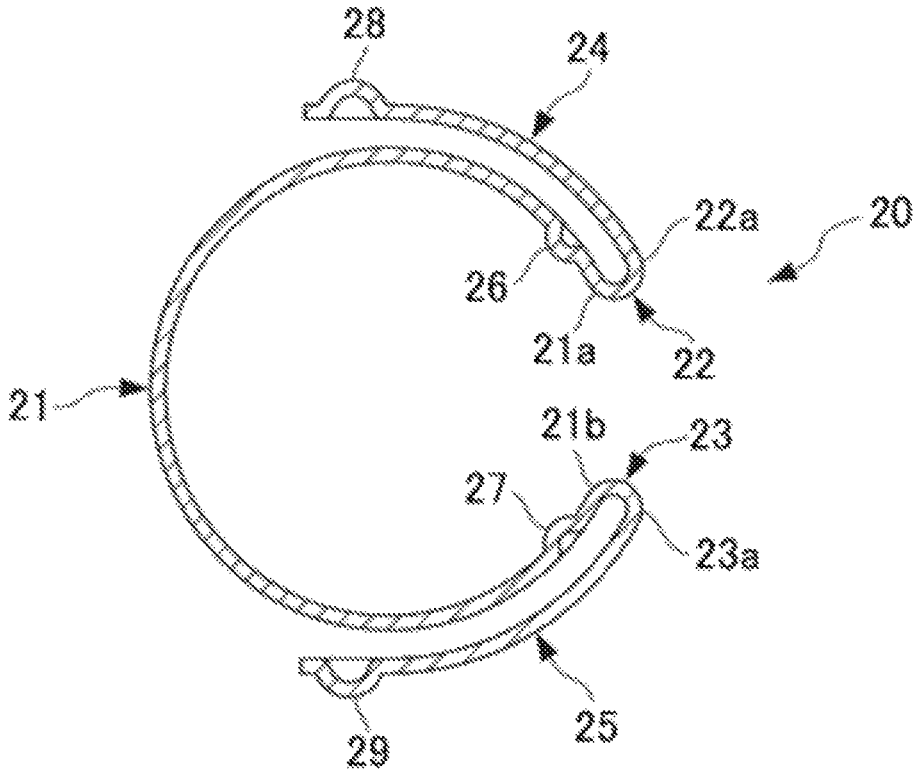
FIG. 8 is a cross sectional view of the metal spring used in the connector according to the embodiment of the present invention, taken along line B-B of FIG. 2B.

FIG. 7 is a perspective view of the metal spring 20 used in the connector 1. FIG. 8 is a cross sectional view of the metal spring 20 used in the connector 1, taken along line B-B of FIG. 2B.

As illustrated in FIG. 1, the metal spring 20 is fitted in between the first flange 13 and the second flange 14, and is provided along the outer peripheral surface of the axial member 10. As a material of the metal spring 20, for example, a copper alloy, titanium, or the like is used. However, the material of the metal spring 20 is not necessarily limited thereto, and can be any metal with elasticity. The metal spring 20 includes a metal spring body 21, the curved parts 22 and 23, the elastic pieces 24 and 25, inner protrusions 26 and 27, and outer protrusions 28 and 29. The metal spring 20 is interposed between the axial member 10 and the cylindrical member 41, which will be described below, to provide stable electric connection between the axial member 10 and the cylindrical member 41.

The metal spring body 21 is a C-shaped portion in which a cutout is provided in cylindrical metal so as to provide a gap between both ends. Here, the both ends of the metal spring body 21 are a body end 21*a* and a body end 21*b*, which correspond to respective tips of the C-shaped portion illustrated in FIG. 8. The body ends 21*a* and 21*b* correspond to both ends according to the present invention. An inner peripheral surface of the metal spring body 21 is provided along the outer peripheral surface of the axial member 10, and as illustrated in FIG. 5, is in contact with the outer peripheral surface of the axial member 10 in an area of more than half of the outer peripheral surface of the axial member 10.

Since the metal spring body 21 is formed in the shape of the letter C, it is possible to easily attach the metal spring 20 to the axial member 10 by opening the body ends 21*a* and 21*b*, which are both ends of the C-shaped metal spring 20, when the metal spring 20 is attached to the axial member 10 from a side direction.

Both the body ends 21*a* and 21*b* of the C-shaped metal spring body 21, and a pair of curved parts, which are curved into the shape of the letter U to be described later, are connected. The inner protrusions 26 and 27, which will be described below, are provided on an inner peripheral surface of the metal spring body 21 so as to protrude inwardly.

As illustrated in FIGS. 7 and 8, the curved parts 22 and 23 are the pair of curved parts connected along the curve to the body ends 21*a* and 21*b*, which are both the ends of the metal spring body 21. The curved parts 22 and 23 are U-shaped portions that are bent from the body ends 21*a* and 21*b* and curved outwardly from the metal spring body 21.

The curved part 22 is connected to the body end 21*a* in a curve. The curved part 23 is connected to the body end 21*b* in a curve. In the metal spring 20, the curved parts 22 and 23 are curved outwardly from the metal spring body 21, and the elastic pieces 24 and 25, which will be described below, extend from curved ends 22*a* and 23*a* of the curved parts 22 and 23, respectively.

The elastic pieces 24 and 25 are a pair of elastic pieces extending from the curved parts 22 and 23, which are a pair of curved parts, so as to face an outer peripheral surface of the metal spring body 21. As illustrated in FIG. 7, the elastic piece 24 extends from the curved end 22*a* of the curved part 22. The elastic piece 25 extends from the curved end 23*a* of the curved part 23.

As described above, the elastic pieces 24 and 25 are made of a copper alloy, titanium, or the like and have elasticity. For example, when an external force is applied from the outside to the inside in a radial direction to the elastic piece 24 illustrated in FIG. 8, the elastic piece 24 is displaced inwardly. In addition, with the above-described external force on the elastic piece 24, through the curved part 22, the external force is also applied to a part of the metal spring body 21 facing the elastic piece 24, causing the part to be displaced inwardly.

Similarly, when an external force is applied to the elastic piece 25 illustrated in FIG. 8 from the outside to the inside in the radial direction, the elastic piece 25 is displaced inwardly. In addition, with the above-described external force on the elastic piece 25, through the curved part 23, the external force is also applied to a part of the metal spring body 21 facing the elastic piece 25, causing the part to be displaced inwardly.

In this way, since the elastic pieces 24 and 25 are displaced when being subjected to an external force, the external force received from the cylindrical member 41, which will be described below, causes the inner protrusions 26 and 27 to be displaced inwardly and causes them to come into contact with the outer peripheral surface of the axial member 10. This enables stable electric connection between the axial member 10 and the metal spring 20 even when there is misalignment between parts.

As illustrated in FIG. 8, the inner protrusions 26 and 27 are provided on the inner peripheral surface of the metal spring body 21 so that the inner protrusions 26 and 27 protrude inside the metal spring body 21, and so that they are in contact with the axial member 10 with an elastic force. The inner protrusion 26 is provided on a side that is closer to the body end 21*a*, which is the end of the C-shaped metal spring body 21. The inner protrusion 27 is provided on a side that is closer to the body end 21*b*, which is the end of the C-shaped metal spring body 21.

An elastic force is generated by an external force received from the cylindrical member 41, which will be described below, so that the inner protrusions 26 and 27 are each displaced inwardly to be brought into contact with the axial member 10.

In the present embodiment, the inner protrusions 26 and 27 are provided, respectively, on the sides closer to the body ends 21*a* and 21*b*, which are both the ends of the inner peripheral surface of the C-shaped metal spring body 21. This makes it easier to transmit a force from pressure to the axial member 10 than when the inner protrusions 26 and 27 are located on sides further away from the curved parts 22 and 23, and therefore contact pressure between the inner protrusion 26, 27 and the axial member 10 can be secured.

The outer protrusion 28 is provided on the outer peripheral surface of the elastic piece 24 so as to protrude outwardly from the elastic piece 24 and is made to be in contact with the cylindrical member 41, which will be described below, that is provided outside the axial member 10 with an elastic force. The outer protrusion 29 is provided on the outer peripheral surface of the elastic piece 25 so as to protrude outwardly from the elastic piece 25 and is made to be in contact with the cylindrical member 41, which will be described below, that is provided outside the axial member 10 with an elastic force.

When the outer protrusion 28 receives an external force from the inner peripheral surface of the cylindrical member 41, which will be described below, the elastic piece 24 is displaced inwardly and also displaces the metal spring body 21 inwardly. When the outer protrusion 29 receives the external force from the inner peripheral surface of the cylindrical member 41, which will be described below, the elastic piece 25 is displaced inwardly and also displaces the metal spring body 21 inwardly.

In the present embodiment, the outer protrusions 28 and 29 are provided, respectively, on tips (on sides further away from the curved parts) of the pair of elastic pieces 24 and 25.

This makes it easier to transmit a force from pressure to the metal spring body 21 than when the outer protrusions 28 and 29 are located on sides closer to the curved parts 22 and 23, and therefore prevents the metal spring 20 from being plastically deformed due to deformations exceeding an elastic range of the metal spring 20.

Figure 9:
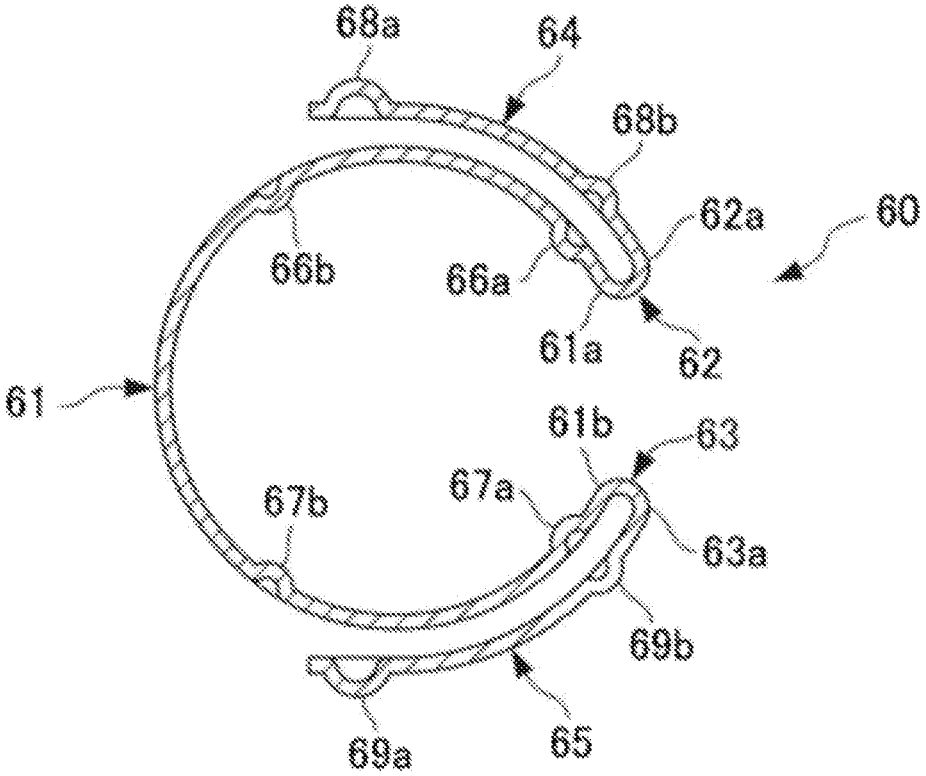
FIG. 9 is a cross sectional view of the metal spring used in the connector according to the embodiment of the present invention, taken along line B-B of FIG. 2B.

FIG. 9 is a cross sectional view of a metal spring 60, which is a variation of the metal spring 20, taken along line B-B of FIG. 2B. FIG. 9 illustrates an example in which a plurality of outer protrusions are provided on outer peripheral surfaces of a pair of elastic pieces 64 and 65, and a plurality of inner protrusions are provided on an inner peripheral surface of a metal spring body 61.

The metal spring 60 is different from the metal spring 20 which has the two inner protrusions, in that it has four inner protrusions, i.e. inner protrusions 66*a*, 66*b*, 67*a*, and 67*b* on the inner peripheral surface of the metal spring body 61.

The metal spring 60 is different from the metal spring 20 which has one outer protrusion on the outer peripheral surface of each elastic piece, in that it has two outer protrusions, i.e. outer protrusions 68*a* and 68*b* on the outer peripheral surface of the elastic piece 64. The metal spring 60 is also different from the metal spring 20 which has one outer protrusion on the outer peripheral surface of each elastic piece, in that it has two outer protrusions, i.e. outer protrusions 69*a* and 69*b* on the outer peripheral surface of the elastic piece 65.

By providing a plurality of outer protrusions, it is possible to disperse the external force received by the elastic pieces 64 and 65 from the cylindrical member 41, which will be described below. Also, by providing a plurality of inner protrusions, it is possible to make the inner protrusions be in contact with the axial member 10 at more points.

Figure 10:
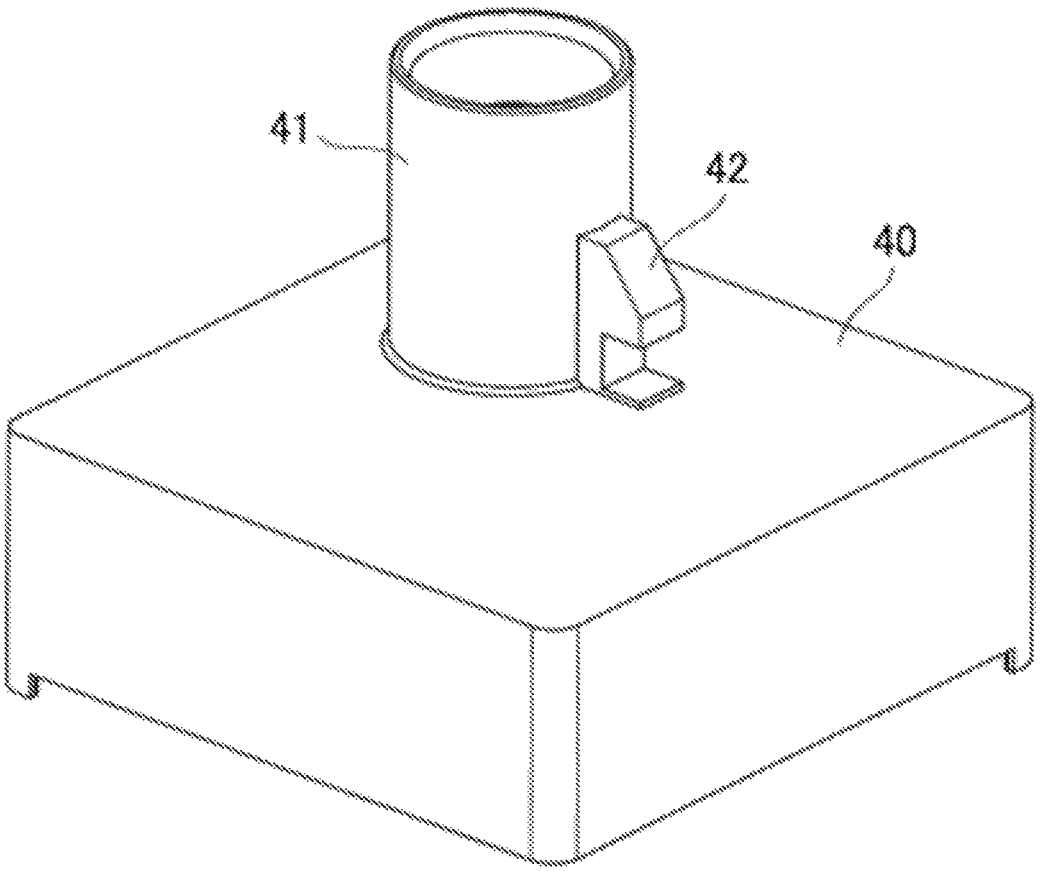
FIG. 10 is a perspective view of a rear case to which the connector according to the embodiment of the present invention is attached.
Figure 11A:
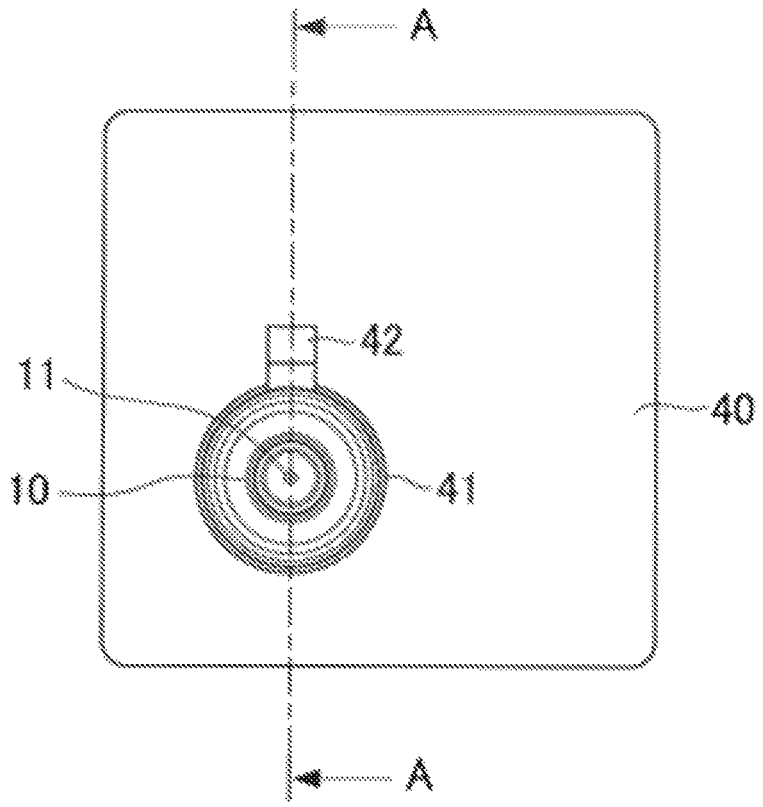
FIG. 11A is a drawing of a top plan view of the rear case to which the connector according to the embodiment of the present invention is attached.
Figure 11B:
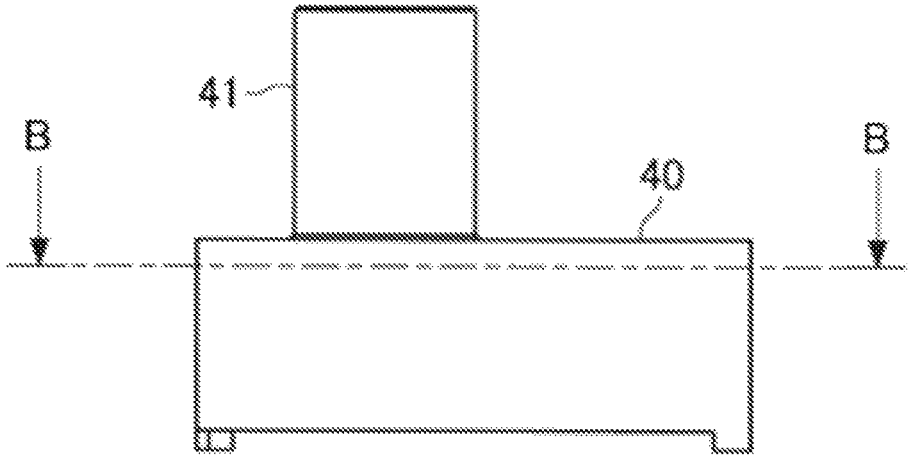
FIG. 11B is a drawing of a front view of the rear case to which the connector according to the embodiment of the present invention is attached.
Figure 11C:
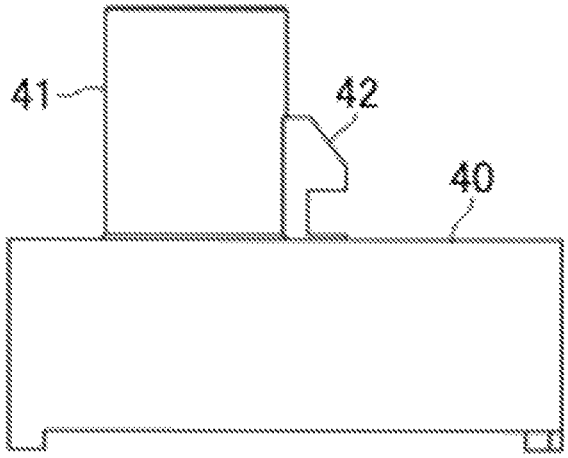
FIG. 11C is a drawing of a right side view of the rear case to which the connector according to the embodiment of the present invention is attached.
Figure 12:
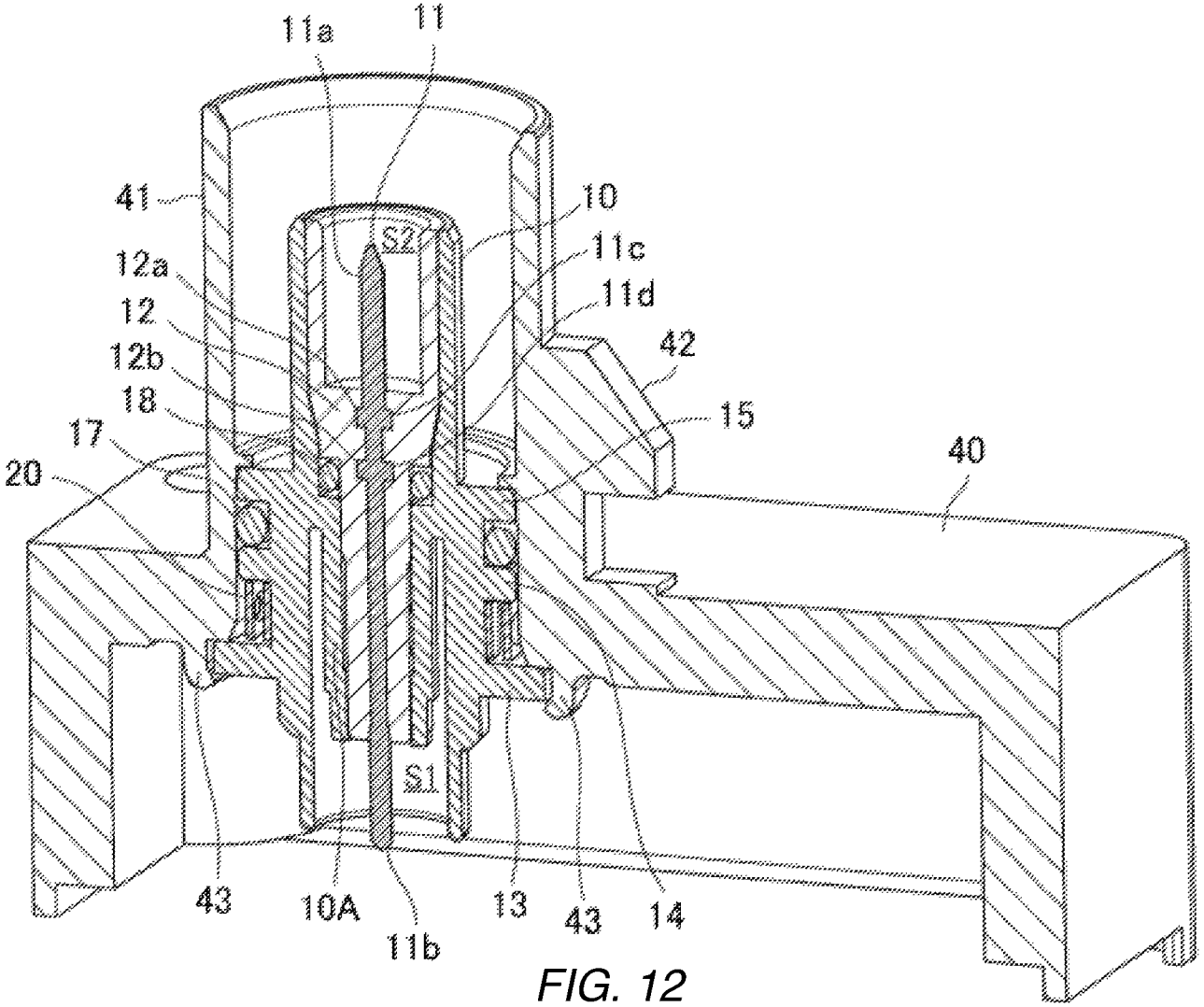
FIG. 12 is a cross sectional view of the connector, in a state of being attached to the rear case, according to the embodiment of the present invention, taken along line A-A of FIG. 11A.

FIG. 10 is a perspective view of the rear case to which the connector 1 of the present embodiment is attached. FIGS. 11A to 11C are drawings of the rear case to which the connector 1 according to the present embodiment is attached, viewed from various directions, in which FIG. 11A is a top plan view, FIG. 11B is a front view, and FIG. 11C is a right side view. FIG. 12 is a cross sectional view of the connector, in a state of being attached to the rear case, according to the present embodiment, taken along line A-A of FIG. 11A.

The connector 1 is used, for example, as a part of an external device such as the rear case for an in-vehicle camera. As illustrated in FIG. 10, a rear case 40 is a rectangular parallelepiped-shaped case and has the cylindrical member 41 at the top. Inside the rear case 40, a not-illustrated board is provided, and a mating connector that is fitted in the connector 1 is mounted on the board. The rear case 40 corresponds to the enclosure according to the present invention.

The cylindrical member 41 is a cylindrical metal conductor provided on the outside of the axial member 10, and is in contact with the outer protrusions 28 and 29 with an elastic force. In other words, the cylindrical member 41 exerts an external force on the outer protrusions 28 and 29 of the axial member 10 and displaces the elastic pieces 24 and 25 inwardly. The axial member 10 is inserted into the inside of the cylindrical member 41. The cylindrical member 41 corresponds to the outer conductor according to the present invention.

As illustrated in FIG. 12, a flange engagement portion 43, which engages with an outer peripheral end of the first flange 13, is formed inside the rear case 40 which includes the cylindrical member 41. The flange engagement portion 43 is formed in a circular shape and is capable of engaging with the first flange 13.

A lock portion 42 is provided on a side of the cylindrical member 41. When the lock portion 42 engages with an external component, the lock portion 42 engages with a lock receiving portion of the mating component to fit the cylindrical member 41 in the mating component.

Figure 13:
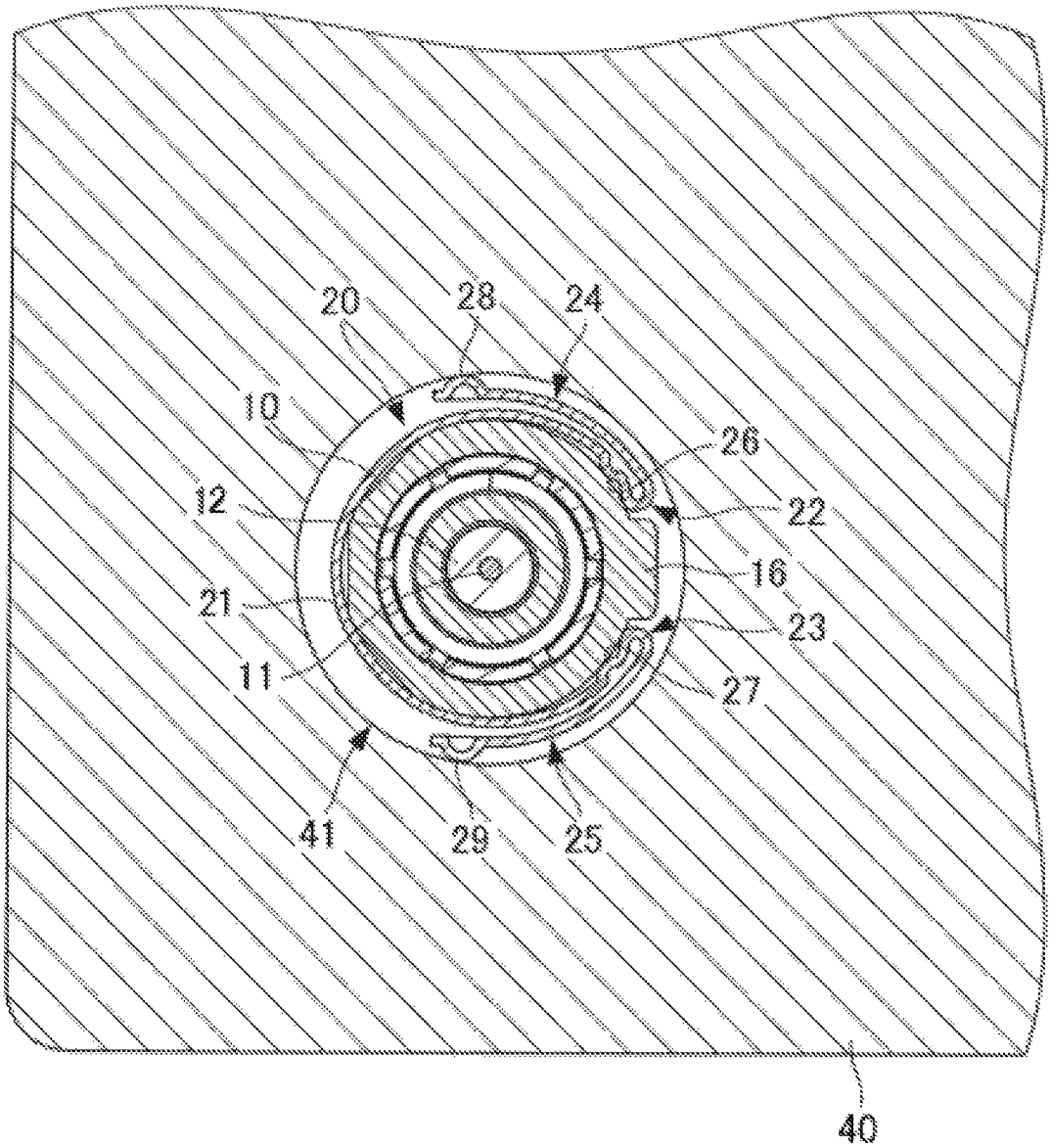
FIG. 13 is a cross sectional view of the connector, in a state of being attached to the rear case, according to the embodiment of the present invention, taken along line B-B of FIG. 11B.

FIG. 13 is a cross sectional view of the connector 1, in a state of being attached to the rear case 40, taken along line B-B of FIG. 11B. The distance between the outer protrusion 28, 29 and the central contact 11 is larger than the inner diameter of the cylindrical member 41 when no external load is applied to the metal spring 20.

Therefore, while in the state illustrated in FIG. 13, an inner peripheral surface of the cylindrical member 41 exerts an external force against the outer protrusion 28 inwardly, and the inner peripheral surface of the cylindrical member 41 is made to be in contact with the outer protrusion 28 with contact pressure, and the elastic piece 24 is displaced inwardly. Similarly, the inner peripheral surface of the cylindrical member 41 exerts the external force against the outer protrusion 29 inwardly, and the inner peripheral surface of the cylindrical member 41 is made to be in contact with the outer protrusion 29 with a certain amount of contact pressure, and the elastic piece 25 is displaced inwardly.

By receiving the above-described inward displacement of the elastic piece 24, the external force is applied onto a portion of the metal spring body 21 facing the elastic piece 24 through the curved part 22, and the portion is then displaced inwardly. As a result, the inner protrusion 26 is displaced inwardly, so that the inner protrusion 26 comes into contact with the outer peripheral surface of the axial member 10 with a certain amount of contact pressure.

Similarly, by receiving the above-described inward displacement of the elastic piece 25, the external force is applied onto a portion of the metal spring body 21 facing the elastic piece 25 through the curved part 23, and the portion is then displaced inwardly. As a result, the inner protrusion 27 is displaced inwardly, so that the inner protrusion 27 comes into contact with the outer peripheral surface of the axial member 10 with a certain amount of contact pressure.

As described above, the connector 1 according to the present embodiment includes: the axial member 10 being the cylindrical conductor; the central contact 11 arranged inside along the central axis of the axial member 10; the insulating member 12 that is interposed between the axial member 10 and the central contact 11 and which holds the central contact 11; the first flange 13 and the second flange 14 that are provided on the outer peripheral surface of the axial member 10 spaced apart in the direction of the central axis of the axial member 10; and the metal spring 20 that is fitted in between the first flange 13 and the second flange 14 and which is provided along the outer peripheral surface of the axial member 10.

The metal spring 20 is configured to include: the C-shaped metal spring body 21 which has the gap between both the ends, i.e. the body ends 21*a* and 21*b* separated by the cutout in the cylindrical metal; the pair of curved parts 22 and 23 that are connected in a curve to the body ends 21*a* and 21*b*, i.e. both ends of the metal spring body 21; the pair of elastic pieces 24 and 25 extending from the pair of curved parts 22 and 23 so as to face the outer peripheral surface of the metal spring body 21; the inner protrusions 26 and 27 that are provided on the inner peripheral surface of the metal spring body 21 so as to protrude inside the metal spring body 21 and be in contact with the axial member 10 with an elastic force; and the outer protrusions 28 and 29 that are provided on the outer peripheral surfaces of the pair of elastic pieces 24 and 25 so as to protrude outside the elastic pieces 24 and 25 and be in contact with the cylindrical member 41 provided outside the axial member 10 with an elastic force.

With this configuration, the connector 1 according to the present embodiment is configured in such a manner that the inner protrusions 26 and 27 provided on the inner peripheral surface of the metal spring body 21 are in contact with the axial member 10 with an elastic force, and the outer protrusions 28 and 29 provided on the outer peripheral surfaces of the elastic pieces 24 and 25, which are located on the metal spring 20, are in contact with the cylindrical member 41 with an elastic force. Therefore, the connector 1 according to the present embodiment enables stable electric connection between the axial member 10 and the cylindrical member 41 via the metal spring 20 even when there is misalignment or the like between parts during use of the connector 1.

In addition, the curved parts 22 and 23, which are curved and folded back, are connected to both the ends of the metal spring body 21, and the metal spring body 21 is formed in the shape of the letter C. Therefore, when the metal spring 20 is attached to the axial member 10 from the side direction, the metal spring 20 can be easily attached to the axial member 10 by opening both the ends, i.e. the body ends 21*a* and 21*b* of the C-shaped metal spring 20.

In addition, in the connector 1 according to the present embodiment, the outer diameter R1 of the first flange 13 is configured to be larger than the outer diameter r formed by the outer peripheral surfaces of the elastic pieces 24 and 25 around the central axis of the axial member 10.

With this configuration, in the connector 1 according to the present embodiment, the outer diameter R1 of the first flange is larger than the outer diameter r formed by the outer peripheral surfaces of the elastic pieces 24 and 25 around the central axis of the axial member 10, so when the cylindrical member 41 is attached to the axial member 10, it is possible to prevent the elastic pieces 24 and 25 from buckling and being damaged.

In addition, in the connector 1 according to the present embodiment, the outer diameter R1 of the first flange 13 is configured to be larger than the outer diameter R2 of the second flange 14.

With this configuration, in the connector 1 according to the present embodiment, since the outer diameter R1 of the first flange 13 is larger than the outer diameter R2 of the second flange 14, the outer peripheral surface of the second flange 14 can be in contact with the cylindrical member 41, while the top surface of the first flange 13 is in contact with the cylindrical member 41.

In addition, the connector 1 according to the present embodiment is configured to further include the third flange 15 on the outer peripheral surface of the axial member 10, and the O-ring 17 for waterproofing is fitted in between the second flange 14 and the third flange 15.

With this configuration, in the connector 1 according to the present embodiment, the O-ring 17 for waterproofing is fitted in between the second flange 14 and the third flange 15, making it possible to prevent water from the flange side from flowing to the side of the rear case 40 which has the cylindrical member 41.

In addition, the connector 1 according to the present embodiment may be configured in such a manner that the four outer protrusions 68*a*, 68*b*, 69*a*, and 69*b* are provided on the outer peripheral surfaces of the pair of elastic pieces 64 and 65.

This configuration allows the connector 1 according to the present embodiment to disperse the external force that the elastic pieces 64 and 65 receive from the cylindrical member 41.

The connector 1 according to the present embodiment is configured to have one outer protrusion 28 at the tip of the elastic piece 24 and one outer protrusion 29 at the tip of the elastic piece 25.

With this configuration, the connector 1 according to the present embodiment has one of the outer protrusions 28 and 29 on each tip of the pair of elastic pieces 24 and 25, respectively. Therefore, it is easier to transmit a force from pressure to the metal spring body 21 than in the case of providing the outer protrusions 28 and 29 on the sides closer to the curved parts 22 and 23. It is also possible to prevent the metal spring 20 from being plastically deformed by deformations exceeding the elastic range of the metal spring 20.

In addition, the connector 1 according to the present embodiment may be configured in such a manner that the four inner protrusions 66*a*, 66*b*, 67*a*, and 67*b* are provided on the inner peripheral surface of the metal spring body 61.

With this configuration, the connector 1 according to the present embodiment allows contact between the metal spring 60 and the axial member 10 at more points, i.e. the inner protrusions 66*a*, 66*b*, 67*a*, and 67*b*.

The connector 1 according to the present embodiment is configured to provide one inner protrusion 26 on the side closer to the body end 21*a* on the inner peripheral surface of the C-shaped metal spring body 21, and one inner protrusion 27 on the side closer to the body end 21*b* on the inner peripheral surface of the C-shaped metal spring body 21.

With this configuration, in the connector 1 according to the present embodiment, the inner protrusions 26 and 27 are provided, respectively, on the sides closer to the body ends 21*a* and 21*b* on the inner peripheral surface of the C-shaped metal spring body 21. This makes it easier to transmit a force from pressure to the axial member 10 than when the inner protrusions 26 and 27 are provided on the sides further away from the curved parts 22 and 23, thus ensuring contact pressure between the inner protrusion 26, 27 and the axial member 10.

In addition, the connector 1 according to the present embodiment is configured in such a manner that the outer peripheral end of the first flange 13 engages with the flange engagement portion 43 in the rear case 40 which includes the cylindrical member 41.

As described above, the connector according to the embodiment of the present invention is able to provide stable electric connection between the inner conductor and the outer conductor, which is useful for connectors in general.

REFERENCE SIGNS LIST

1 connector
10 axial member (inner conductor)
10*a* cylindrical piece
11 central contact
12 insulating member
13 first flange
14 second flange
15 third flange
16 protrusion
17, 18 O-ring
20, 60 metal spring
21, 61 metal spring body

21*a*, 21*b*, 61*a*, 61*b* body end (both ends)
22, 23, 62, 63 curved part
24, 25, 64, 65 elastic piece
26, 27, 66*a*, 66*b*, 67*a*, 67*b* inner protrusion
28, 29, 68*a*, 68*b*, 69*a*, 69*b* outer protrusion
40 rear case (enclosure)
41 cylindrical member (outer conductor)
42 lock portion
43 flange engagement portion

The invention claimed is:

1. A connector comprising:

an inner conductor that is a cylindrical conductor;

a central contact that is disposed inside along a central axis of the inner conductor;

an insulating member that is interposed between the inner conductor and the central contact and which holds the central contact;

a first flange and a second flange that are provided on an outer peripheral surface of the inner conductor spaced apart in a direction of the central axis; and a metal spring that is fitted in between the first flange and the second flange and is provided along the outer peripheral surface of the inner conductor, the metal spring including:

a C-shaped metal spring body which has a gap between both ends separated by a cutout in a cylindrical metal;

a pair of curved parts connected in a curve to both the ends of the metal spring body;

a pair of elastic pieces that extend from the pair of curved parts, respectively, so as to face an outer peripheral surface of the metal spring body;

an inner protrusion that is provided on an inner peripheral surface of the metal spring body so as to protrude inside the metal spring body, and be in contact with the inner conductor with an elastic force; and an outer protrusion that is provided on an outer peripheral surface of at least one of the pair of elastic pieces so as to protrude outside the at least one of the pair of elastic pieces, and be in contact with a cylindrical outer conductor provided outside the inner conductor with an elastic force.

2. The connector according to claim 1, wherein an outer diameter of the first flange is larger than an outer diameter formed by the outer peripheral surfaces of the elastic pieces around a central axis of the inner conductor.

3. The connector according to claim 1, wherein an outer diameter of the first flange is larger than an outer diameter of the second flange.

4. The connector according to claim 1, further comprising a third flange on the outer peripheral surface of the inner conductor, and an O-ring, for waterproofing, fitted in between the second flange and the third flange.

5. The connector according to claim 1, wherein the outer protrusion includes a plurality of outer protrusions provided on the outer peripheral surfaces of the pair of elastic pieces.

6. The connector according to claim 1, wherein the outer protrusion is provided one each at each tip of the pair of elastic pieces.

7. The connector according to claim 1, wherein the inner protrusion includes a plurality of inner protrusions provided on the inner peripheral surface of the metal spring body.

8. The connector according to claim 1, wherein the inner protrusion is provided one each on each end of the inner peripheral surface of the C-shaped metal spring body.

9. The connector according to claim 1, wherein an outer peripheral end of the first flange engages with a flange engagement portion in an enclosure which includes the outer conductor.

* * * * *